US008011509B1

(12) United States Patent
Sakamaki et al.

(10) Patent No.: US 8,011,509 B1
(45) Date of Patent: Sep. 6, 2011

(54) PRODUCT PACKAGE AND PRIZE FOR CRANE CLAW ARCADE GAME

(75) Inventors: Yoshitaka Sakamaki, Bensenville, IL (US); Akio Fujii, Bensenville, IL (US); Darin Pilcher, Bensenville, IL (US); Jim Wulfers, Downers Grove, IL (US)

(73) Assignee: NAMCO Cybertainment Inc., Wood Dale, IL (US)

( * ) Notice: Subject to any disclaimer, the term of this patent is extended or adjusted under 35 U.S.C. 154(b) by 0 days.

(21) Appl. No.: 12/752,682

(22) Filed: Apr. 1, 2010

(51) Int. Cl.
*A63F 11/00* (2006.01)

(52) U.S. Cl. ..... 206/457; 273/148 R; 273/447

(58) Field of Classification Search ..... None
See application file for complete search history.

(56) References Cited

U.S. PATENT DOCUMENTS 2,174,687 A * 10/1939 Comley ..... 229/110
4,187,977 A * 2/1980 Boykin et al. ..... 229/114
4,948,035 A * 8/1990 Wischoff ..... 229/110
5,115,965 A * 5/1992 Girona Alepuz ..... 229/109
5,465,901 A * 11/1995 Paine, Jr. ..... 229/407
6,938,818 B2 * 9/2005 Moorman et al. ..... 229/122
7,004,378 B1 * 2/2006 Tharpe, Jr. ..... 229/120
7,806,313 B2 * 10/2010 Philips ..... 229/109
2005/0274778 A1 * 12/2005 Rubyan et al. ..... 229/103

OTHER PUBLICATIONS

Photograph, GLICO brand box, understood to be commercially available at least as early as Mar. 31, 2010.

* cited by examiner

*Primary Examiner* — Jacob K Ackun
(74) *Attorney, Agent, or Firm* — Marshall, Gerstein & Borun LLP

(57) ABSTRACT

A package for storing a prize associated with a crane claw arcade game includes a sidewall, a first and second end panels, a cavity, at least one first side aperture, and optionally at least one second side aperture. The sidewall includes a plurality of side panels, wherein each includes opposing first and second side edges and opposing first and second end edges. The cavity is adapted to store the prize associated with the crane claw arcade game. The first side aperture is defined by a first side panel of the plurality of side panels, and the optional second side aperture is defined by a second side panel of the plurality of side panels. The first and second side apertures are adapted to receive a finger of a claw of the crane claw arcade game to facilitate retrieval of the package from a housing of the arcade game.

4 Claims, 3 Drawing Sheets

PRODUCT PACKAGE AND PRIZE FOR CRANE CLAW ARCADE GAME

FIELD OF THE DISCLOSURE

The present disclosure relates to packaging for products and, more particularly, to packaging for products that constitute prizes associated with an arcade game such as a crane claw arcade game.

BACKGROUND

Crane claw arcade games 1 such as that depicted in FIG. 1 are popular amusement devices often located in arcades, bingo halls, convenience stores, toll road rest stops, shopping malls, and many other public places. In these types of games, prizes 10 are stored within a gaming area 12 of an enclosed housing 14 and are viewable by a player through one or more windows of the housing 14, for example. Upon the insertion of a coin or token, the player may control a mechanical claw 18 or other pick-up device via a joystick 20, one or more buttons, or a toggle switch, for example. Typically, the mechanical claw 18 is disposed above the prizes 10 and the player may change the three-dimensional position of the claw 18. At the player's discretion, and typically within a pre-set time limit, the claw 18 may be lowered toward the prizes with the intention of grasping one or more of the prizes 10. In FIG. 1, the claw 18 includes three fingers 22, which occupy an open state prior to the claw 18 being lowered, and once the claw 18 reaches the level of the prizes, the fingers 22 close in an attempt to grasp a prize 10. Subsequent to closing, the claw 18 is raised and moved above a dispensing chute, the outlet 21 of which is seen in FIG. 1, for example. The fingers 22 of the claw 18 are then opened by the player to allow any prize 10 that may be grasped thereby to drop into the dispensing chute and out to the player. If no prize 10 was grasped by the claw 18, the player does not receive a prize and game play ends.

Typical prizes for crane claw arcade games are configured to sonic extent to facilitate grasping by the fingers of the claw. For example, some typical prizes include stuffed items such as animals, dolls, sports equipment, etc., that may be squeezed by the fingers of the claw. Other prizes may include plastic or metal items with loops of material extending therefrom such that one or more of the fingers of the claw may penetrate the loop(s) to grasp the item. Finally, some other prizes include t-shirts, knit hats, or other items constructed from textiles that may be folded, rolled, or otherwise arranged in a bundle of a predetermined size for facilitating grasping by the claw.

SUMMARY

The present disclosure is generally directed to a package and/or a prize that includes a carton or container, for example, having at least one aperture formed therein to facilitate grasping with a claw of a crane claw arcade game. That is, during operation of a crane claw arcade game, a user may aim to hook one or more fingers of the claw of the game into the at least one aperture to thereby retain the package and/or prize. According to the disclosure, the at least one aperture is not limited in size, shape, or quantity. That is, the at least one aperture may be circular, triangular, square, rectangular, pentagonal, hexagonal, heptagonal, octagonal, nonagonal, decagonal, etc. Moreover, the package and/or prize may include one aperture, two apertures, three apertures, four apertures, five apertures, six apertures, seven apertures, etc. Finally, the apertures may be of generally any desirable size and they may be equal in size or different in size. Smaller apertures may enable a more challenging game, while larger apertures may enable an easier game.

Therefore, one aspect of the present disclosure includes a package for storing a prize associated with a crane claw arcade game. The package includes a sidewall, a first end panel, a second end panel, a cavity, at least one first side aperture, and at least one second side aperture. The sidewall may be of circular cross-section such that the package represents a cylinder or may alternatively include a plurality of side panels disposed adjacent to one another, wherein each side panel includes a pair of opposing first and second side edges and a pair of opposing first and second end edges. The first end panel is disposed adjacent to the first end edges of the plurality of side panels. The second end panel is disposed adjacent to the second end edges of the plurality of side panels. The cavity is defined by the sidewall and is disposed between the first and second end panels, and is adapted to store the prize associated with the crane claw arcade game. The at least one first side aperture is located on the surface of the sidewall or is defined by a first side panel of the plurality of side panels, and adapted to receive a finger of a claw of the crane claw arcade game to facilitate retrieval of the package from a housing of the arcade game.

In some aspects, the package further includes at least one second side aperture located on the surface of the sidewall or defined by a second side panel of the plurality of side panels.

In some aspects, the at least one first side aperture includes a pair of first side apertures, and/or the at least one second side aperture includes a pair of second side apertures.

In some aspects, the pair of first side apertures are arranged on a first centerline that bisects the first and second end edges of the first side panel, and/or the pair of second side apertures are arranged on a second centerline that bisects the first and second end edges of the second side panel.

In some aspects, the package further includes at least one first end aperture defined by the first end panel and may also include at least one second end aperture defined by the second end panel, wherein the first and second end apertures adapted to receive a finger of a claw of the crane claw arcade game to facilitate retrieval of the package from a housing of the arcade game.

In some aspects, the sidewall may have a cross-section that is one of circular, elliptical, ovular, parabolic, triangular, square, pentagonal, hexagonal, heptagonal, octagonal, nonaganal, and decagonal.

In some aspects, the sidewall includes a hexagonal cross-section and the plurality of side panels comprises the first side panel, the second side panel, a third side panel, a fourth side panel, a fifth side panel, and a sixth side panel. However, the disclosure is not limited to a hexagonal cross-section and may alternatively include square, rectangular, pentagonal, heptagonal, or octagonal and other geometric cross-sections.

In some aspects, the package may further include at least one third side aperture defined by the third side panel and adapted to receive a finger of the claw of the crane claw arcade game to facilitate retrieval of the package from the housing of the arcade game.

In some aspects, the fourth side panel is disposed between the first and second side panels, the fifth side panel is disposed between the second and third side panels, and the sixth side panel is disposed between the first and third side panels.

In some aspects, the fourth, fifth, and sixth side panels comprise solid panels.

In sonic aspects, the package further includes a window defined by the fourth side panel, the window including a transparent sheet of material providing a line of sight into the cavity of the package.

Another aspect of the present disclosure includes a package for storing a prize associated with a crane claw arcade game. The package includes a sidewall, a first end panel, a second end panel, a cavity, a first multitude of side panels, and a second multitude of side panels. The sidewall includes a plurality of side panels disposed adjacent to one another, wherein each side panel including a pair of opposing first and second side edges and a pair of opposing first and second end edges. The first end panel is disposed adjacent to the first end edges of the plurality of side panels. The second end panel is disposed adjacent to the second end edges of the plurality of side panels. The cavity is defined by the sidewall and is disposed between the first and second end panels, wherein the cavity adapted to store the prize associated with the crane claw arcade game. The first multitude of side panels of the plurality of side panels each includes at least one aperture for facilitating retrieval of the package from a housing of the arcade game with a claw. The second multitude of side panels of the plurality of side panels are solid, and each of the panels of the second multitude of panels being disposed between an adjacent pair of the first multitude of panels.

In some aspects, each side panel of the first multitude of side panels includes a pair of apertures arranged on a common centerline that bisects the first and second end edges of the panel, each aperture of each pair of apertures adapted to receive a finger of the claw of the arcade game to facilitate retrieval of the package.

In some aspects, the package further includes a first end aperture disposed in the first end panel, and optionally a second end aperture disposed in the second end panel, the first and second end panels adapted to receive a finger of the claw of the arcade game to facilitate retrieval of the package.

In some aspects, the sidewall has a cross-section that is one of circular, elliptical, ovular, parabolic, triangular, square, pentagonal, hexagonal, heptagonal, octagonal, nonaganal, and decagonal.

In some aspects, the sidewall comprises a hexagonal cross-section, and the first multitude of side panels comprises first, second, and third side panels, and the second multitude of side panels comprises fourth, fifth, and sixth side panels, wherein the fourth side panel is disposed between the first and second side panels, the fifth side panel is disposed between the second and third side panels, and the sixth side panel is disposed between the first and third side panels.

In some aspects, the package further includes a window defined by one of the panels of the second multitude of panels, the window including a transparent sheet of material providing a line of sight into the cavity of the package.

Another aspect of the present disclosure includes a prize associated with a crane claw arcade game. The prize includes a sidewall, a first end panel, a second end panel, a cavity, a toy, and first through sixth side panels. The sidewall has a hexagonal cross-section and includes a first end, a second end, and a plurality of side panels disposed adjacent to one another. The first end panel is disposed adjacent to the first end of the sidewall and defining a first end aperture. The second end panel is disposed adjacent to the second end sidewall and defining a second end aperture. The cavity is defined by the sidewall and disposed between the first and second end panels. The toy is disposed within the cavity. The first side panel of the plurality of side panels defines a pair of first side apertures. The second side panel of the plurality of side panels defines a pair of second side apertures. The third side panel of the plurality of panels defines a pair of third side apertures, wherein each aperture of the first end aperture, the second end aperture, and the pairs of first, second, and third side apertures are adapted to receive a finger of a claw of the crane claw arcade game to facilitate retrieval of the prize. The fourth side panel of the plurality of side panels is solid and disposed between the first and second side panels. The fifth side panel of the plurality of panels is solid and disposed between the second and third side panels. The sixth side panel of the plurality of side panels is solid and disposed between the first and third side panels.

DETAILED DESCRIPTION

Figure 1:
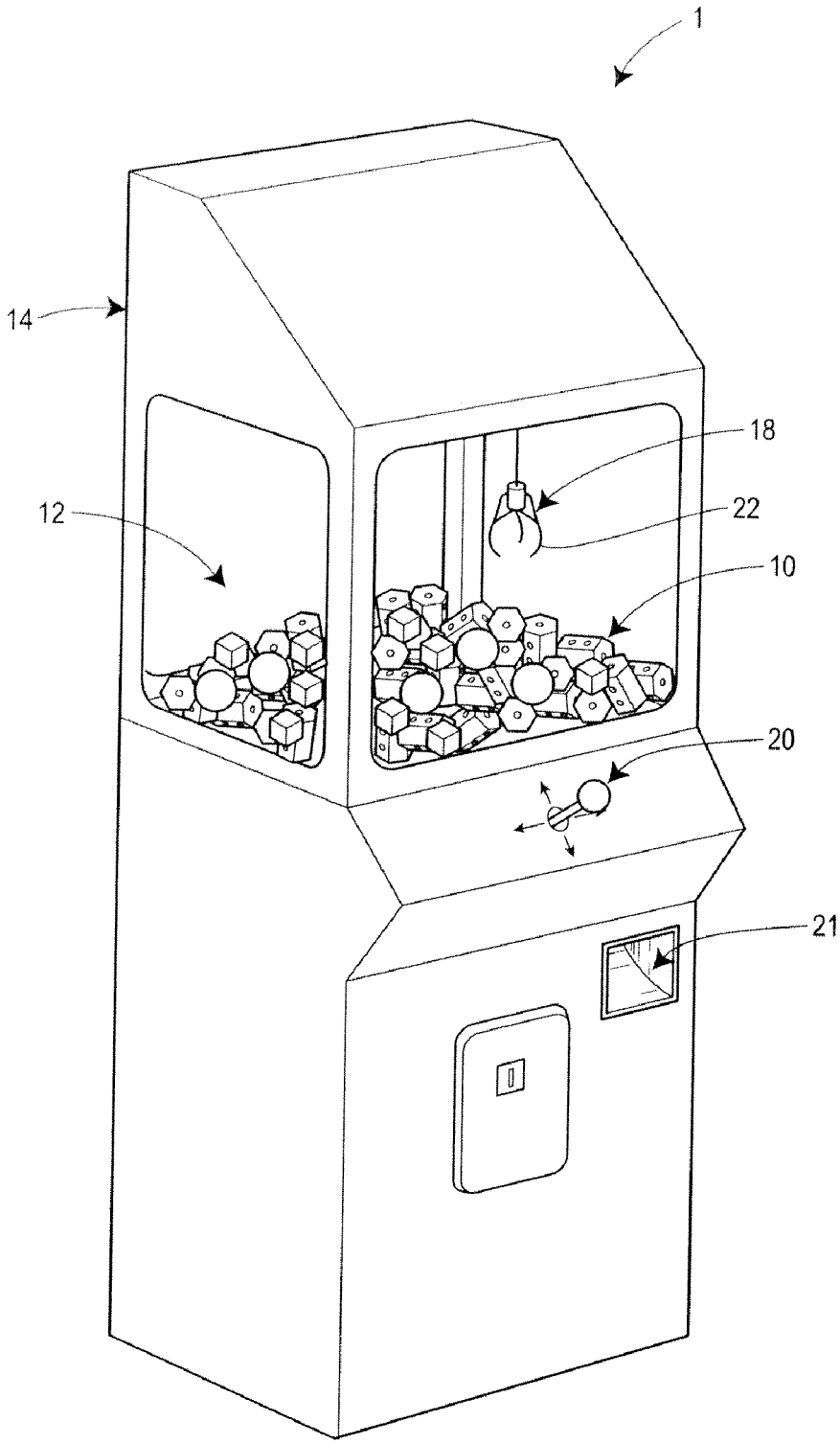
FIG. 1 is a perspective view of a crane claw arcade game including a plurality of various prizes stored within a housing thereof.
Figure 2:
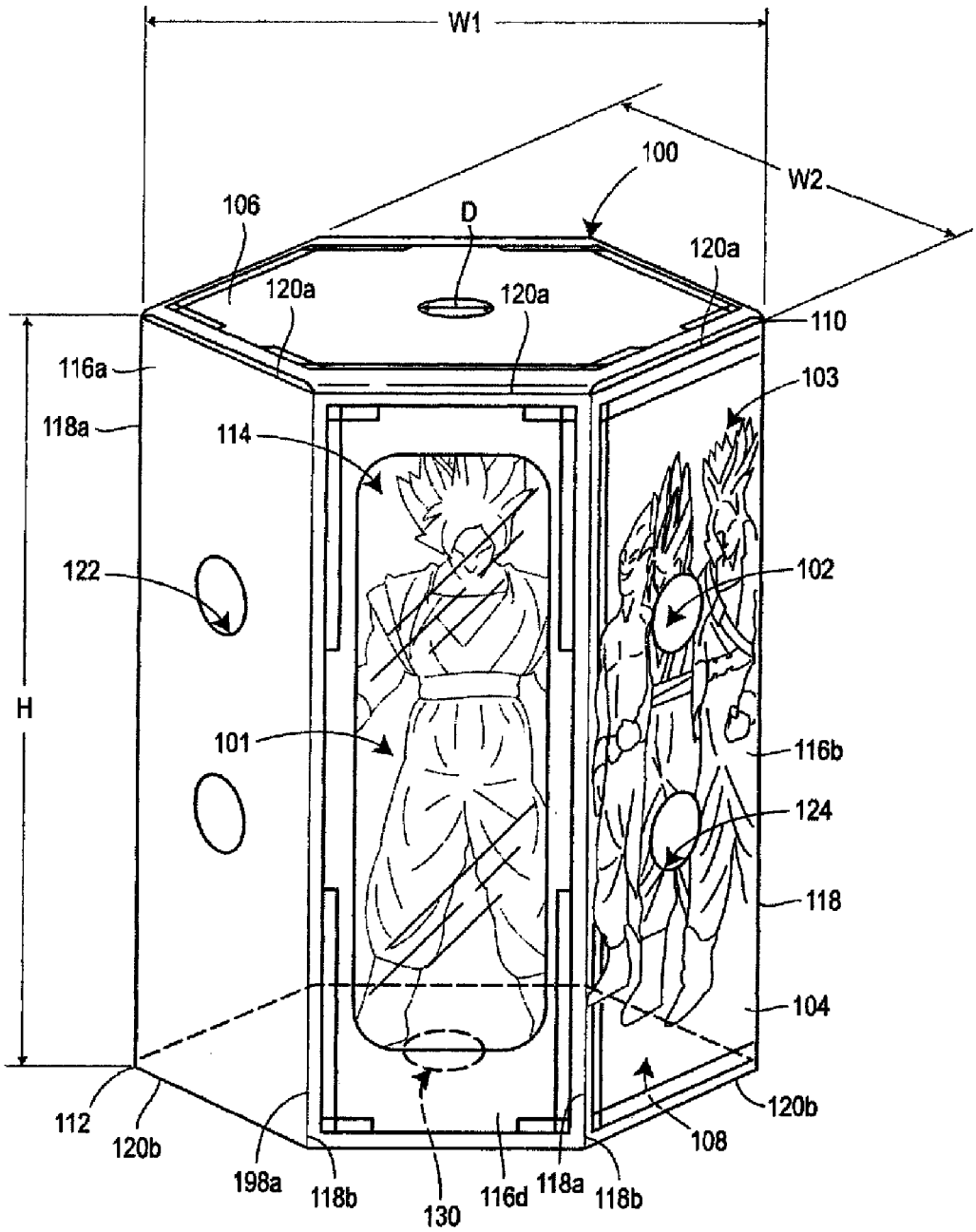
FIG. 2 is a perspective view of a package for a prize for a crane claw arcade game constructed in accordance with the principles of the present disclosure in which the package is depicted as having a hexagonal cross-section.

FIG. 2 illustrates a package 100 constructed in accordance with the principles of the present disclosure, which may contain and/or comprise a prize such as the prizes 10 illustrated inside of the crane claw arcade game 1 depicted in FIG. 1. That is, the package 10 is adapted for to be retrieved from a crane claw arcade game, such as the three-finger crane claw arcade game described above with respect to FIG. 1. To facilitate such retrieval, the package 100 may include a plurality of apertures 102, only one of which is numbered in FIG. 2. The apertures 102 are adapted to receive the fingers 22 of the claw 18 of the crane claw arcade game, as will be described in more detail below.

As shown, the package 100 includes a carton or container, for example, and is adapted to contain a prize 101 such as a toy, an action figure, or some other prize, gift, or product. In some embodiments, the package 100 may include graphics or other indicia 103 printed on the outside thereof and associated with the prize 101 contained therewithin. For example, in the depicted embodiment, the graphics 103 include images of multiple different action figures, at least one of which may be included within the package 100.

Still referring to FIG. 2, the disclosed embodiment of the package 100 includes a sidewall 104, a first end panel 106, and a second end panel 108. The sidewall 104 of the present embodiment includes a hexagonal cross-section, and therefore, includes six sides defined by first through sixth side panels **116*a*-116*f* (only three of which are depicted in FIG. 2), a first end 110, and a second end 112. In the present embodiment, the sidewall 104 is slightly elongated in that its longer than it is wide. As such, the sidewall 104** could be described as being generally tubular or tube-shaped, for example.

While the sidewall 104 of the present embodiment is hexagonal in cross-section, other embodiments of the package 100 may include a sidewall with a cross-section of generally any polygonal shape, e.g., triagonal, square, rectangular, pentagonal, heptagonal, octagonal, nonagonal, decagonal, etc. Further embodiments of the package 100 may have a sidewall that is generally cylindrical with a cross-section that is circular, elliptical, ovular, parabolic, or any other shape. Still further embodiments may have a sidewall with a varying cross-section that includes any combination of the foregoing shapes. That is, some embodiments of the package may have different portions with different cross-sections. For example, in one embodiment, the package may be shaped similar to a dumbbell and have end portions with polygonal cross-sections, and a mid-portion with a cylindrical cross-section. In still further embodiments, the package 100 may have generally any three-dimensional shape such as a sphere, a partial sphere, a pyramid, etc. Thus, it should be appreciated that the package and/or prize of the present disclosure is not limited to the general shape or cross-section of the embodiment expressly described herein.

Each of the side panels 116*a*-116*f* of the presently disclosed embodiment includes opposing first and second side edges 118*a*, 118*b* and opposing first and second end edges 120*a*, 120*b*. The first end edges 120*a* are disposed at the first end 110 of the package 100 and the second end edges 120*b* are disposed at the second end 112 of the package 100. The first end panel 106 of the package 100 is disposed adjacent to the first end 110 of the sidewall 104 and, therefore, the first end edges 120*a* of each of the side panels 116*a*-116*f*. Similarly, the second end panel 108 of the package 100 is disposed adjacent to the second end 112 of the sidewall 104, and therefore, the second end edges 120*b* of the side panels 116*a*-116*f*. Moreover, the first and second end panels 106, 108 are shaped to generally correspond with the cross-section of the sidewall 104 of the package 100. Therefore, in this embodiment, the end panels 106, 108 are hexagonal in shape. So configured, the package 100 defines a cavity 114 disposed within the sidewall 104 and between the first and second end panels 106, 108. Due to the shape of the sidewall 104, the cavity 114 of the present embodiment also includes a hexagonal cross-section.

Figure 3:
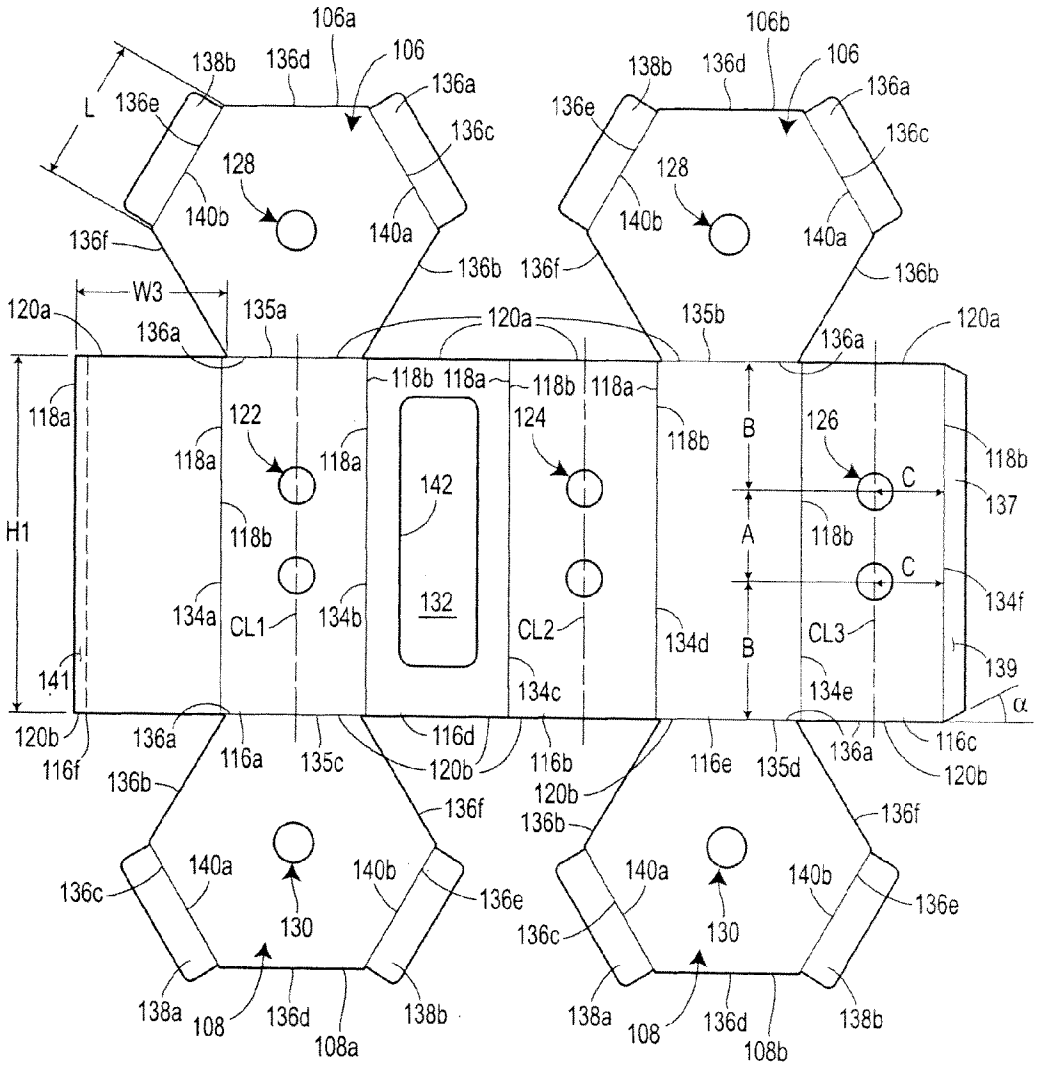
FIG. 3 is a plan view of the package of FIG. 2 disassembled.

As mentioned, the package 100 includes a plurality of apertures 102 for facilitating retrieval of the package 100 from a crane claw arcade game. More specifically, the package 100 of the present disclosure includes apertures formed in every other side panel 116*a*-116*f* of the six-sided sidewall, and in the end panels 106, 108. Said another way, and as shown in FIG. 3, every other side panel 116*a*-116*f* and the end panels 106, 108 have a plurality of holes in them, while the remainder side panels 116*a*-116*f* are solid. For example, as depicted in FIG. 3, the package 100 includes a first pair of apertures 122 in the first side panel 116*a*, a second pair of apertures 124 in the second side panel 116*b*, a third pair of apertures 126 in the third side panel 116*c*, a first end aperture 128 in the first end panel 106, and a second end aperture 130 in the second end panel 108. As shown in FIG. 3, and which will be described in greater detail below, each of the first and second end panels 106, 108 of the presently disclosed embodiment of the package 100 are constructed from a pair of panels (i.e., inside panels 106*a*, 108*a* and outside panels 106*b*, 108*b*), and therefore, the first and second end apertures 128, 130 are similarly defined by corresponding pairs of apertures in the pairs of first and second end panels 106*a*, 106*b*, 108*a*, 108*b*. The fourth, fifth, and sixth side panels 116*d*, 116*e*, and 116*f* are solid and disposed between the first, second, and third side panels 116*a*, 116*b*, and 116*c*. That is, the fourth side panel 116*d* is disposed between the first and second side panels 116*a*, 116*b*; the fifth side panel 116*e* is disposed between the second and third side panels 116*b*, 116*c*; and the sixth side panel 116*f* is disposed between the first and third side panels 116*a*, 116*c*.

With the foregoing configuration and referring back to FIG. 2, each of the side panels 116*a*-116*f* of the hexagonal package 100 of the present embodiment is disposed at an angle of approximately one hundred and twenty degrees relative to its immediately adjacent side panels 116*a*-116*f* because the sidewall 104 of the package 100 is arranged as a generally hexagonal cylinder. Moreover, because of this configuration, the first pair of apertures 122 may be described as being disposed in a first plane that is defined by and/or occupied by the first side panel 116*a*, and which is disposed at an angle of approximately sixty degrees from a second plane that is defined by and/or occupied by the second side panel 116*b*, which defines the second pair of apertures 124. Moreover, the first plane occupied by the first plurality of apertures 122 may be described as being disposed at an angle of approximately sixty degrees relative to a third plane that is defined by and/or occupied by the third side panel 116*c*, which defines the third pair of apertures 126. Finally, this configuration provides that the second plane, within which the second pair of apertures 124 are disposed, is disposed at an angle of approximately sixty degrees relative to the third plane, within which the third pair of apertures 126 are disposed. The number of the plurality of apertures 102, and the angular orientation of the first, second, and third pairs of apertures 122, 124, 126 may facilitate retrieval of the package 100 from the three-finger crane claw arcade game, while also requiring the player to exhibit at least some level of skill to complete such as task. For example, if each side panel 116*a*-116*f* included apertures, and an unlimited number of apertures, perhaps it would be too easy for a player to retrieve the package. Simplifying game play to such an extent may be undesirable because the player may not feel challenged by the game.

In one embodiment, and referring back to FIG. 3, the package 100 disclosed herein may be constructed from a single piece of material such as cardboard, for example, with the exception of an optional viewing window 132. Other embodiments of the package 100 may be constructed of a plastic, a fabric, a composite, a fiberglass, a glass, a wood, or generally any other material capable of serving the disclosed purpose. In some embodiments, the package 100 may be constructed of a transparent or translucent material such that the contents of the package 100 are readily visible through the sidewall 104 and/or end panels 106, 108*n* with or without the need for the viewing window 132.

The single piece of material may be formed via a stamping operation, for example, or any other process. As shown in FIG. 3, each of the side panels 116*a*-116*f* and end panels 106, 108 are constructed from a single piece of material and connected by a plurality of foldable seams. For example, the first side edge 118*a* of the first side panel 116*f* is connected the second side edge 118*b* of the sixth side panel 116*f* at a first foldable side seam 134*a*; the first side edge 118*a* of the fourth side panel 116*d* is connected the second side edge 118*b* of the first side panel 116*a* at a second foldable side seam 134*b*; the first side edge 118*a* of the second side panel 116*b* is connected the second side edge 118*b* of the fourth side panel 116*d* at a third foldable side seam 134*c*; the first side edge 118*a* of the fifth side panel 116*e* is connected to the second side edge 118*b* of the second side panel 116*b* are fourth foldable side seam 134*d*; and the first side edge 118*a* of the third side panel 116*c* is connected to the second side edge 118*b* of the fifth side panel 116*e* at a fifth foldable side seam 134*e*. Furthermore, the package 100 depicted in FIG. 3 includes a glue tab 137 attached along the second side edge 118*b* of the third side panel 116*c* at a sixth foldable side seam 134*f*. The foldable side seams 134*a*-134*f* and the glue tab 137 facilitate assembly and/or assist in maintaining the integrity of the assembled package 100, as will be described.

As mentioned above, the disclosed embodiment of the package 100 includes inside and outside first end panels 106*a*, 106*b*, as well as inside and outside second end panels 108*a*, 108*b*. Each of the first and second end panels 106*a*, 106*b*,

108*a*, 108*b* is hexagonal in shape to correspond with the shape of the constructed package 100 depicted in FIG. 2, for example. More specifically, each of the first and second end panels 106*a*, 106*b*, 108*a*, 108*b* includes first through sixth side edges 136*a*-136*f* arranged in the shape of a hexagon. Moreover, because the package 100 is constructed from a single piece of material, each of the first and second end panels 106*a*, 106*b*, 108*a*, 108*b* is connected to one of the side panels 116*a*-116*f*.

More specifically, the first side edge 136*a* of the inside first end panel 106*a* is connected to the first end edge 120*a* of the first side panel 116*a* at a first foldable end seam 135*a*; the first side edge 136*a* of the outside first end panel 106*b* is connected to the first end edge 120*a* of the fifth side panel 116*e* at a second foldable end seam 135*b*; the first side edge 136*a* of the inside second end panel 108*a* is connected to the second end edge 120*b* of the first side panel 116*a* at a third foldable end seam 135*c*; and the first side edge 136*a* of the outside second end panel 108*b* is connected to the second end edge 120*b* of the fifth side panel 116*e* at a fourth foldable end seam 135*d*. Further still, as depicted, each of the end panels 106*a*, 106*b*, 108*a*, 108*b* includes a first and second assembly tabs 138*a*, 138*b*. The first assembly tabs 138*a* are connected to the third side edges 136*c* of the respective end panels 106*a*, 106*b*, 108*a*, 108*b* at a first foldable assembly seam 140*a*, and the second assembly tabs 138*b* are connected to the fifth side edges 136*e* of the respective end panels 106*a*, 106*b*, 108*a*, 108*b* at a second foldable assembly seam 140*b*. The foldable end seams 135*a*-135*d*, the foldable assembly seams 140*a*, 140*b*, and the first and second assembly tabs 138*a*, 138*b* on each end panel 106*a*, 106*b*, 108*a*, 108*b* facilitate assembly and/or assist in maintaining the integrity of the assembled package 100, as will be described.

Still referring to FIGS. 2 and 3 and as mentioned above, the plurality of apertures 102 are arranged on the first, second, and third side panels 116*a*-116*c*, as well as the first and second end panels 106, 108 for facilitating retrieval of the assembled package 100 from a crane claw arcade game. The specific arrangement and configuration of the present embodiment of the plurality of apertures 102 in the package 100 will now be described in detail. For example, as illustrated in FIG. 2, the first and second end apertures 128, 130 are disposed substantially at the centers of the hexagonal inside and outside first and second end panels 106*a*, 106*b*, 108*a*, 108*b*. As shown in FIG. 3, the first pair of side apertures 122 are defined by the first side panel 116*a* and spaced apart along a common centerline CL1 that bisects the first and second end edges 120*a*, 120*b* of the first side panel 116*a*. The second pair of side apertures 124 are defined by the second side panel 116*b* and spaced apart along a common centerline CL2 that bisects the first and second end edges 120*a*, 120*b* of the second side panel 116*b*. The third pair of side apertures 126 are defined by the third side panel 116*c* and spaced apart along a common centerline CL3 that bisects the first and second end edges 120*a*, 120*b* of the third side panel 116*c*.

So configured, the plurality of apertures 102 are arranged to advantageously facilitate the reception of one or more fingers of a claw of a crane claw arcade game such that a player may successfully retrieve the package 100, at least some of the time. Moreover, the specifically disclosed arrangement of the plurality of apertures 102 may preferably be used in connection with three-finger crane claw arcade games, but may also provide similar benefits to two-claw crane claw arcade games, for example.

As mentioned above, the package 100 of the present embodiment includes a viewing window 132. The viewing window 132 is carried by the fourth side panel 116*d* of the package 100 and includes a generally rectangular opening 142 and apiece of transparent material 144 adhered to the side panel 116*d* adjacent to the opening 142. The viewing window 132 is arranged to provide a line of sight into the cavity 114 of the package 100, such that a player of the crane claw arcade game may see the prize that he/she is attempting to retrieve. While the window 132 is disclosed as being located in the fourth side panel 116*d*, alternative embodiments may include a viewing window in any one or more of the side panels 116*a*-116*f*.

To assemble the package 100 of the present disclosure, the side panels 116*a*-116*f* are folded about the first through fifth foldable side seams 134*a*-134*e* such that each side panel 116*a*-116*f* is disposed at an angle of approximately one hundred and twenty degrees relative to its immediately adjacent side panels 116*a*-116*f*. Then, the glue tab 137 may be folded along the sixth foldable side seam 134*f* to an angle of approximately one hundred and twenty degrees relative to the third side panel 116*c*. An adhesive may then be applied to an outer surface 139 of the glue tab 137 and the glue tab 137 may be adhered to an inner surface 141 of the sixth side panel 116*f* adjacent to the first side edge 118*a* of the sixth side panel 116*f*. After the glue sets, the sidewall 104 of the package 100 may be manipulated to correspond to its intended hexagonal configuration. Then, the assembly tabs 138*a*, 138*b* on each of the end panels 106*a*, 106*b*, 108*a*, 108*b* may be folded about the respective assembly seams 140*a*, 140*b* into a position that is generally perpendicular to the respective end panels 160*a*, 106*b*, 108*a*, 108*b*.

So configured, the inside first end panel 106*a* may be folded about the first end seam 135*a* into a position approximately perpendicular to the first side panel 116*a*. In this position, the assembly tabs 138*a*, 138*b* on the inside first end panel 106*a* slide into the package 100 adjacent the second and third side panels 116*b*, 116*c*, respectively. Once the inside first end panel 106*a* is in position, the outside first end panel 106*b* may be folded about the second end seam 135*b* into a position approximately perpendicular to the fifth side panel 116*e*. In this position, the outside first end panel 106*b* lies substantially flat against an outer surface of the inside first end panel 106*a*, and the assembly tabs 138*a*, 138*b* on the outside first end panel 106*b* slide into the package 100 adjacent to the sixth and fourth side panels 116*f*, 116*d*, respectively. Then, in some embodiments, a small piece of adhesive tape or other mechanical fastener may be used to secure the outside first end panel 106*b* to one or more of the side panels 116*a*-116*f* of the sidewall 104 to increase the integrity of the package 100.

Once the first end panels 106*a*, 106*b* are secured in position, the package 100 may be flipped upside down such that the open second end 112 of the package 100 faces upward. At this point, a prize may be positioned into the cavity 114 of the package 100 and the inside and outside second end panels 108*a*, 108*b* may be folded about the third and fourth end seams 135*c*, 135*d* and assembled in a manner generally identical to the first end panels 106*a*, 106*b* described above. The package 100 including the prize 101 is then prepared to be put into a crane claw arcade game to be retrieved by a player.

As mentioned, the present embodiment of the package 100 is designed for use with a three-finger crane claw arcade game. As such, one embodiment of the product package may be dimensioned to facilitate its cooperation with three-finger claw mechanisms. Specifically, as shown in FIG. 2, the assembled package 100 may have a height H, a major width W1, and a minor width W2. The height H may be approximately 16 cm, the major width W1 may be approximately 13 cm, and the minor width W2 may be approximately 11.5 cm. Moreover, each of the apertures 122, 124, 126, 128, 130 of the plurality of apertures 102 may have a common diameter D, which may be approximately 1.5 cm.

With reference to FIG. 3, in order to construct the package 100 with the dimensions provided above, each of the side panels 116*a*-116*f* includes a common height H1 and a common width W3. The height H1 of the side panels 116*a*-116*f* is approximately equal to the height H of the package 100 and therefore is approximately equal to 16 cm. The common width W3 of the side panels 116*a*-116*f* is approximately 6.5 cm. Moreover, the first and second end panels 106*a*, 106*b*, 108*a*, 108*b* are sized to correspond to the size of the package 100 described above, in that the side edges 136*a*-136*f* of each end panel 106*a*, 106*b*, 108*a*, 108*b* includes a common length L. The length L in the disclosed embodiment is approximately equal to the width W3 of the side panels 116*a*-116*f*, which is approximately 6.5 cm.

Further still, as mentioned above, the pairs of apertures 122, 124, 126 defined by the first, second, and third side panels 116*a*-116*c* are spaced along centerlines CL1-CL3 that bisect the respective first and second end edges 120*a*, 120*b* of the side panels 116*a*-116*c*. More specifically, the pairs of apertures 122, 124, 126 are spaced apart from each other a distance A, spaced from the respective first and second end edges 120*a*, 120*b* of the side panels 116*a*-116*c* a distance B, and spaced from the respective first and second side edges 118*a*, 118*b* a distance C. In the disclosed embodiment, the distance A is approximately 4 cm, the distance B is approximately 6 cm, and the distance C is approximately 3.25 cm.

While the foregoing description has provided a set of specific dimensions for the various features of the disclosed package 100, packages constructed of different sizes, proportions, etc. are intended to be within the scope of the present application.

Accordingly, the invention described in this document is not in any regard limited to the specific embodiment or embodiment described herein, but rather, include anything that may be encompassed within the scope of the pending claims, and equivalents thereof.

What is claimed:

1. A prize associated with a crane claw arcade game, the prize comprising:

a sidewall having a hexagonal cross-section, the sidewall comprising a first end, a second end, and a plurality of side panels disposed adjacent to one another;

a first end panel disposed adjacent to the first end of the sidewall and defining a first end aperture;

a second end panel disposed adjacent to the second end sidewall and defining a second end aperture;

a cavity defined by the sidewall and disposed between the first and second end panels;

a toy disposed within the cavity;

a first side panel of the plurality of side panels defining a pair of first side apertures;

a second side panel of the plurality of side panels defining a pair of second side apertures;

a third side panel of the plurality of panels defining a pair of third side apertures, each aperture of the first end aperture, the second end aperture, and the pairs of first, second, and third side apertures adapted to receive a finger of a claw of the crane claw arcade game to facilitate retrieval of the prize;

a fourth side panel of the plurality of side panels being solid and disposed between the first and second side panels;

a fifth side panel of the plurality of panels being solid and disposed between the second and third side panels;

a sixth side panel of the plurality of side panels being solid and disposed between the first and third side panels.

2. The prize of claim 1, wherein the first end aperture, the second end aperture, and the pairs of first, second, and third side apertures have a common size and shape.

3. The prize of claim 1, wherein the pair of first side apertures are arranged on a first centerline that bisects first and second end edges of the first side panel, the pair of second side apertures are arranged on a second centerline that bisects first and second end edges of the second side panel, and the pair of third side apertures are arranged on a third centerline that bisects first and second end edges of the third side panel.

4. The prize of claim 1, further comprising a window defined by the fourth side panel, the window including a transparent sheet of material providing a line of sight into the cavity.

* * * * *